US011564461B2

(12) United States Patent
Chung et al.

(10) Patent No.: US 11,564,461 B2
(45) Date of Patent: Jan. 31, 2023

(54) STRAP ADAPTER AND ELECTRONIC DEVICE INCLUDING THE SAME

(71) Applicant: Samsung Electronics Co., Ltd., Suwon-si (KR)

(72) Inventors: Insik Chung, Suwon-si (KR); Junghwa Cho, Suwon-si (KR); Yongseok Bang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 412 days.

(21) Appl. No.: 16/898,204

(22) Filed: Jun. 10, 2020

(65) Prior Publication Data

US 2020/0383434 A1 Dec. 10, 2020

(30) Foreign Application Priority Data

Jun. 10, 2019 (KR) ..... 10-2019-0067786

(51) Int. Cl.

| | |
|---|---|
| ***A44C 5/14*** | (2006.01) |
| ***G04G 17/08*** | (2006.01) |
| ***A44C 5/00*** | (2006.01) |

(52) U.S. Cl.

CPC ..... *A44C 5/147* (2013.01); *A44C 5/0053* (2013.01); *G04G 17/08* (2013.01); *A44D 2203/00* (2013.01)

(58) Field of Classification Search

None

See application file for complete search history.

(56) References Cited

U.S. PATENT DOCUMENTS

| | | | | |
|---|---|---|---|---|
| 10,058,148 | B1 * | 8/2018 | Wittenberg | A44C 5/2057 |
| 2016/0004222 | A1 * | 1/2016 | Barnes | G04B 37/1493 368/281 |
| 2016/0170445 | A1 | 6/2016 | Wai | |
| 2017/0258186 | A1 | 9/2017 | Schooley et al. | |
| 2017/0265607 | A1 | 9/2017 | Hatanaka et al. | |

FOREIGN PATENT DOCUMENTS

| | | | |
|---|---|---|---|
| JP | 3122408 | U | 6/2006 |
| KR | 10-2017-0116485 | A | 10/2017 |

* cited by examiner

*Primary Examiner* — Kristy A Haupt

(57) ABSTRACT

An electronic device may include a main body including a front plate, a rear plate disposed to be spaced apart from the front plate, a lateral member surrounding a space between the front plate and the rear plate, and a display viewed through at least a portion of the front plate. The electronic device may further include a housing having a space therein and combined with a strap at one side thereof in a first axial direction, a first fastening part protruding from another side of the housing toward the main body and detachably connected to the main body, a second fastening part formed in the main body and engaged with the first fastening part, and a button disposed in the housing, exposed at least in part to an outside of the housing, and moving the first fastening part to be separated from the second fastening part.

20 Claims, 11 Drawing Sheets

STRAP ADAPTER AND ELECTRONIC DEVICE INCLUDING THE SAME

CROSS-REFERENCE TO RELATED APPLICATION

This application is based on and claims priority under 35 U.S.C. 119 to Korean Patent Application No. 10-2019-0067786 filed on Jun. 10, 2019 in the Korean Intellectual Property Office, the disclosure of which is herein incorporated by reference in its entirety.

BACKGROUND

1. Field

The disclosure relates to a strap adapter and an electronic device including the same.

2. Description of Related Art

With the growths of related technologies, portable electronic devices have evolved in various fields and have become popularized. These portable electronic devices are being developed to have various sizes and shapes and now evolving into fashion items with a beautiful design while having a form that can be worn on a user's body.

Typically, such a wearable electronic device may include a strap. For example, a smart watch is worn on a user's wrist through the strap. Replacing various straps according to time, place, and occasion, the user can use the wearable electronic device as a fashion item.

However, when the replacement of the strap is cumbersome, there may be a limit to use the wearable electronic device as a fashion item. Accordingly, there is a need to provide an efficient fastening structure capable of easily attaching/detaching the strap to/from a main body of the wearable electronic device.

SUMMARY

According to an embodiment of the disclosure, a strap adapter may include a housing having a space therein and combined with a strap at one side thereof in a first axial direction, a first fastening part protruding from other side of the housing and connected to a main body, and a button disposed in the housing, exposed at least in part to an outside of the housing, and moving the first fastening part to be separated from the main body.

According to an embodiment of the disclosure, an electronic device may include a main body including a front plate, a rear plate disposed to be spaced apart from the front plate, a lateral member surrounding a space between the front plate and the rear plate, and a display viewed through at least a portion of the front plate, a housing having a space therein and combined with a strap at one side thereof in a first axial direction, a first fastening part protruding from other side of the housing toward the main body and connected to the main body, a second fastening part formed in the main body and engaged with the first fastening part, and a button disposed in the housing, exposed at least in part to an outside of the housing, and moving the first fastening part to be separated from the second fastening part.

According to another embodiment of the disclosure, an electronic device may include a main body including a front plate, a rear plate disposed to be spaced apart from the front plate, a lateral member surrounding a space between the front plate and the rear plate, and a display viewed through at least a portion of the front plate, a third fastening part combined with a strap at one side thereof in a first axial direction and protruding from other side thereof toward the main body to be connected to the main body, a fourth fastening part formed in the main body and engaged with the third fastening part, and a button disposed in the main body, exposed at least in part to an outside of the main body, and moving the fourth fastening part to be separated from the third fastening part.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Now, embodiments of the disclosure will be described in detail with reference to the accompanying drawings.

Figure 1:
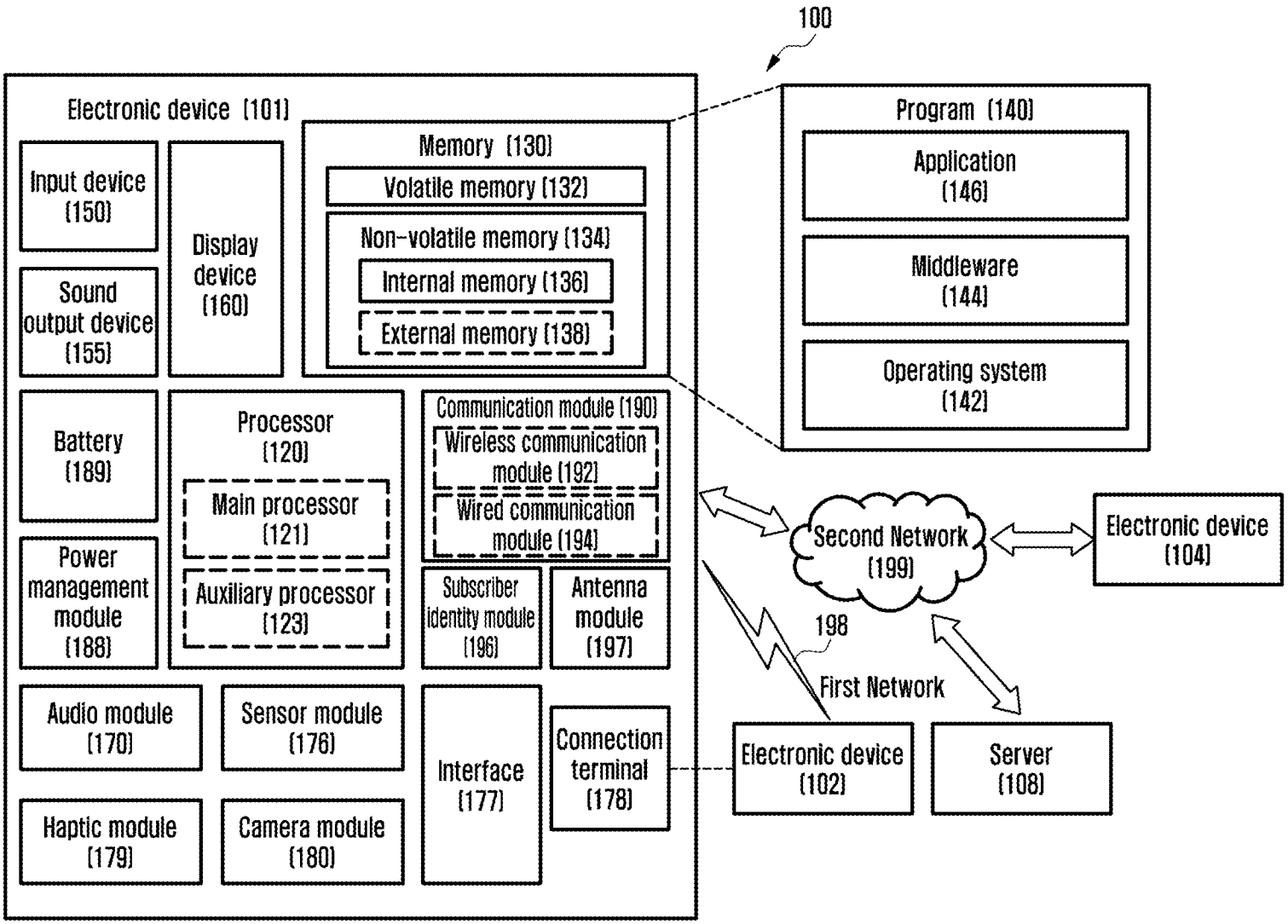
FIG. 1 is a block diagram illustrating an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
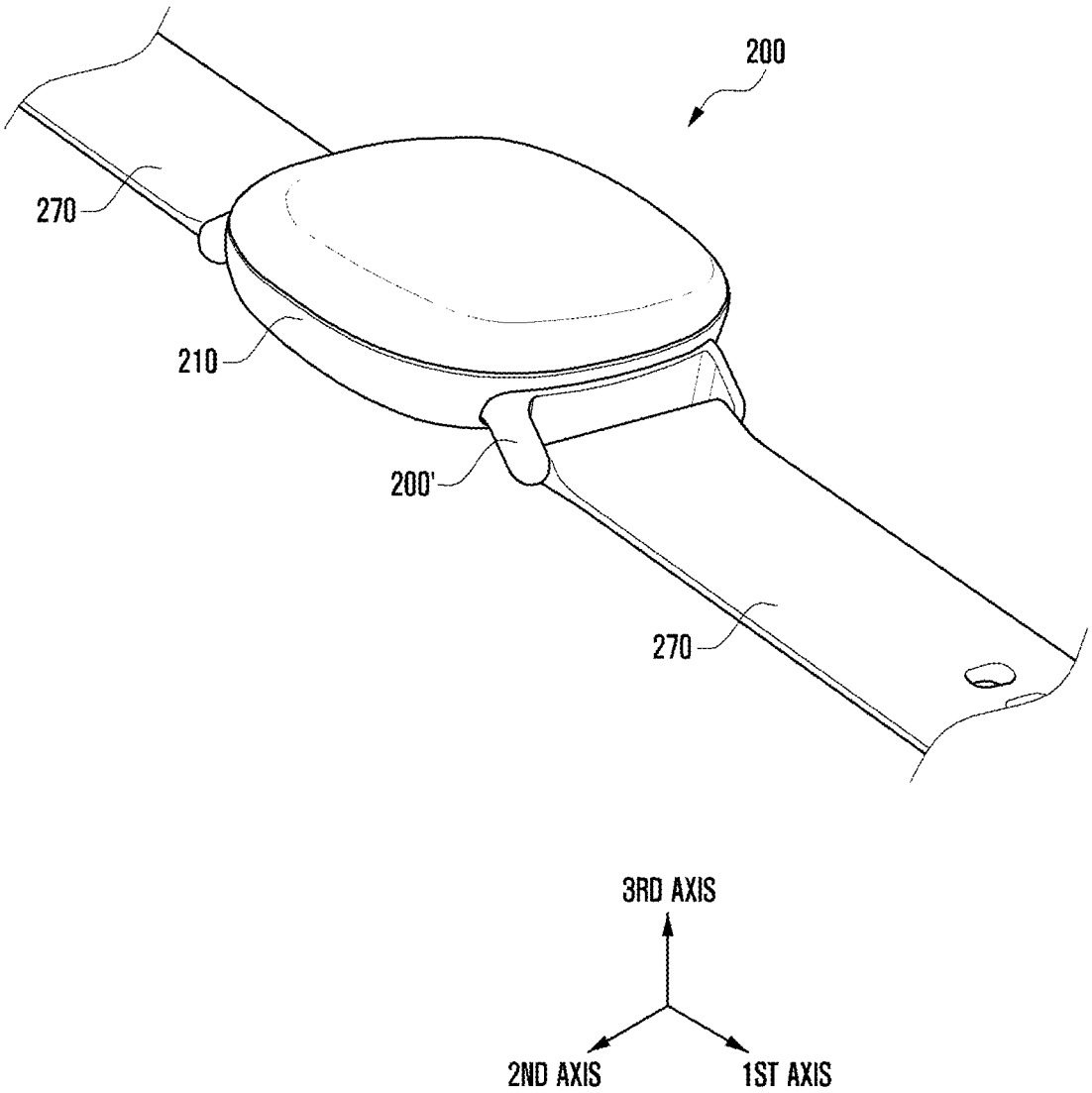
FIG. 2 illustrates a perspective view showing an electronic device according to an embodiment of the disclosure.
Figure 3:
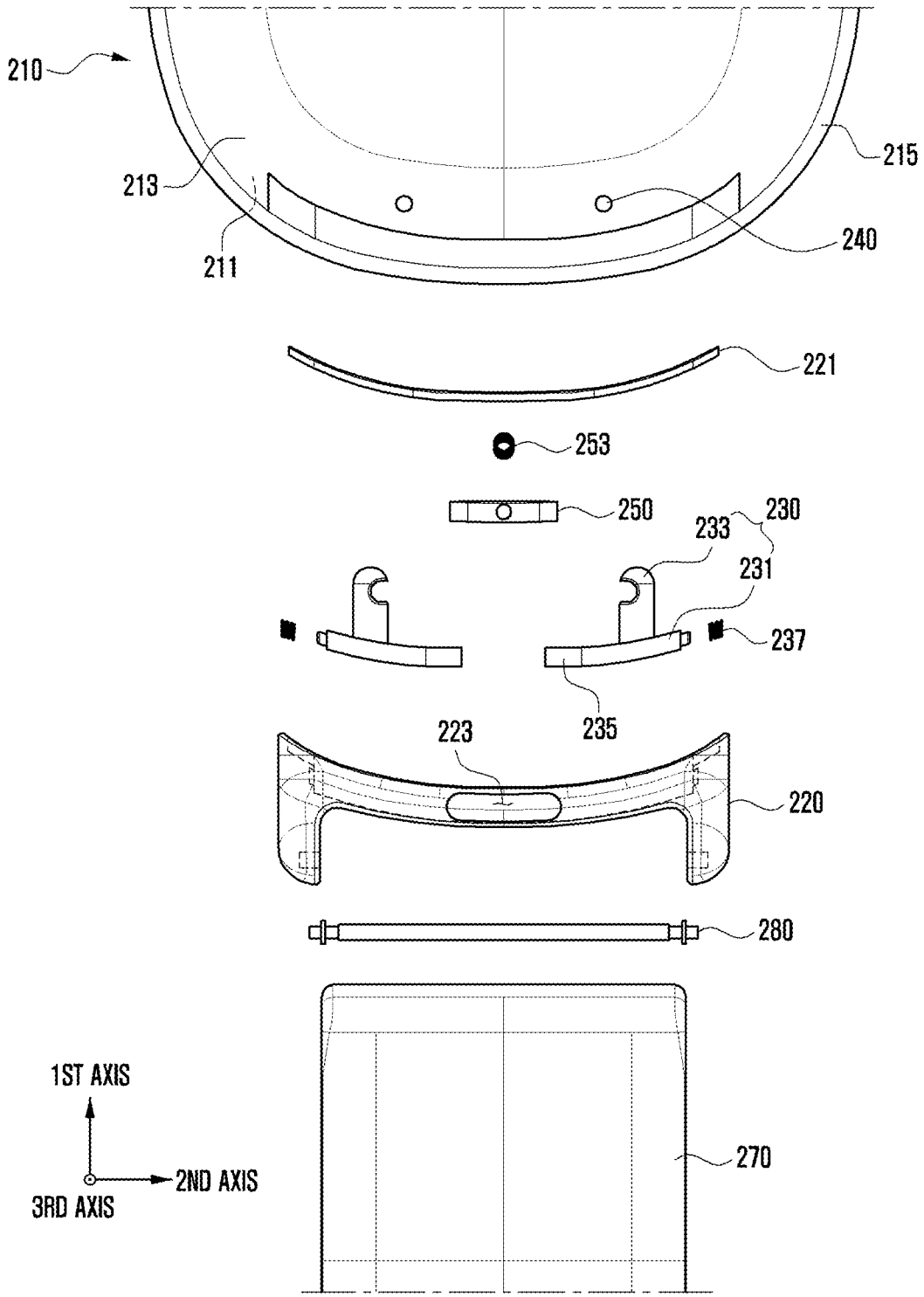
FIG. 3 illustrates an exploded view showing an electronic device 200 exploded to the center of a strap adapter 200' according to an embodiment of the disclosure.

FIG. 2 illustrates a perspective view showing an electronic device 200 according to an embodiment of the disclosure, and FIG. 3 illustrates an exploded view showing an electronic device 200 exploded to the center of a strap adapter 200' according to an embodiment of the disclosure.

In describing hereinafter the electronic device 200 according to various embodiments of the disclosure, the same or similar reference numerals may be used for denoting the same or similar elements. Also, in describing the electronic device 200, a first axial direction, a second axial direction, and a third axial direction may correspond to directions of three axes which are used to define a three-dimensional space. For example, when the first axial direction indicates an x-axial direction, the second axial direction may indicate a y-axial direction, and the third axial direction may indicate a z-axial direction. In an embodiment, the first axial direction may indicate a length direction of a strap 270, and the second axial direction may indicate a width direction of the strap 270 which is perpendicular to the first axial direction. Further, the third axial direction may indicate a thickness direction of a main body 210 which is perpendicular to both the first axial direction and the second axial direction.

Referring to FIGS. 2 and 3, the electronic device 200 according to an embodiment may include the main body 210, a strap adapter 200', and/or the strap 270.

According to an embodiment, the main body 210 may be a wearable electronic device itself, for example, a smart watch, which can be worn on a user's body with the strap 270. The main body 210 may include a front plate 211, a rear plate 213 disposed to be spaced apart from the front plate 211, a lateral member 215 surrounding a space between the front plate 211 and the rear plate 213, and a display viewed through the front plate 211. Although the main body 210 shown in FIG. 2 has a rectangular-like shape, the shape of the main body 210 is not limited thereto.

According to an embodiment, the strap adapter 200' may be an element for connecting the main body 210 and the strap 270. Specifically, one side of the strap adapter 200' may be combined with the strap 270, and the other side may be detachably connected to the main body 210. The one side of the strap adapter 200' may be combined with the strap 270 through a spring bar 280. Using the strap adapter 200' according to an embodiment makes it possible to connect not only the strap 270 dedicated to the electronic device 200 according to an embodiment but also any strap of a wearable electronic device or of a normal watch to the main body 210 of the electronic device 200. The strap adapter 200' may be disposed on each of both sides of the main body 210 in the first axial direction. The strap 270 may be composed of one piece or, as in case of a normal watch, composed of two pieces. The user can attach or detach the strap adapter 200' combined with the strap 270 to or from the main body 210 of the electronic device 200.

As shown in FIG. 3, the strap adapter 200' according to an embodiment may include a housing 220, a first fastening part 230, and/or a button 250.

According to an embodiment, the housing 220 may have a space therein and form an appearance of the strap adapter 200'. In the first axial direction, one side of the housing 220 may be combined with the strap 270. For example, the one side of the housing 220 may be combined with the strap 270 through the spring bar 280 as shown. Alternatively, the housing 220 may be formed integrally with the strap 270. The other side of the housing 220, which corresponds to a direction toward the main body 210 of the electronic device 200, may be formed to resemble an outline shape of the main body 210 to be connected. For example, the other side of the housing 220 may be formed in a concave shape according to the shape of the lateral member 215 of the main body 210, thereby being in close contact with the main body 210. The other side of the housing 220 may have an opening. Various components of the strap adapter 200' may be disposed in the space of the housing 220 and exposed through the opening. The opening may be closed by a housing cover 221. The housing cover 221 may be formed to have a curved surface conforming to the shape of the lateral member 215 of the main body 210. In another embodiment, the housing 220 and the housing cover 221 may not be separately formed. The housing 220 may have a hole 223 formed to accommodate the button 250 in one surface of the housing 220 of the third axial direction (i.e., in a surface having the same direction as the rear plate 213 of the main body 210). The button 250 is exposed at least in part through the hole 223, so that the user can press the button 250.

According to an embodiment, the first fastening part 230 may be disposed in the housing 220. A plurality of first fastening parts 230, e.g., a pair of first fastening parts as shown, may be disposed in the second axial direction. Each of the first fastening parts 230 may include a fastening body 231, a fastening hook 233, and a fastening body inclined plane 235. The fastening bodies 231 of the first fastening parts 230 may be disposed in the space of the housing 220 and may move slidingly to be away from or close to each other in the second axial direction. An elastic body such as a spring 237 may be disposed between the fastening body 231 and an inner wall of the housing 220 in the second axial direction to provide an elastic force for moving the fastening body 231 to the center of the housing 220. Thus, the fastening bodies 231 move away from each other by a user's manipulation of pressing the button 250 and then be returned to be close to each other by the elastic force when the button press is removed.

The fastening hook 233 of the first fastening part 230 may be formed to protrude from the fastening body 231 toward the main body 210 in the first axial direction. The fastening hook 233 may have a hook-shaped end to be engaged with a second fastening part 240 (e.g., a pin) formed on the main body 210 to connect the strap adapter 200' and the main body 210. The shape or structure of the fastening hook 233 is not limited to an example shown in FIG. 3, and any shape or structure that allows engaging or releasing responsive to the movement of the fastening body 231 may be applied. Disposing the second fastening part 240 having a simple structure such as a pin in the main body 210 of the electronic device 200 and also embedding the remaining structure in the strap adapter 200' makes it possible to improve an inner design freedom of the main body 210.

The fastening body inclined plane 235 of the first fastening part 230 may be formed at one end of the fastening body 231, this end being positioned toward the center of the housing 220 along the second axial direction. The fastening body inclined plane 235 may be in contact with a button inclined plane (251 in FIG. 4B). When the user presses the button 250, an interaction between the fastening body inclined plane 235 and the button inclined plane 251 allows the fastening bodies 231 to be away from each other along the second axial direction.

The button 250 may be disposed in the hole 223 of the housing 220 and exposed in part to the outside of the housing 220 through the hole 223. When the user manipulates the button 250 in the third axial direction, the button 250 may be pressed toward or restored from the inner space of the housing 220.

Figure 4A:
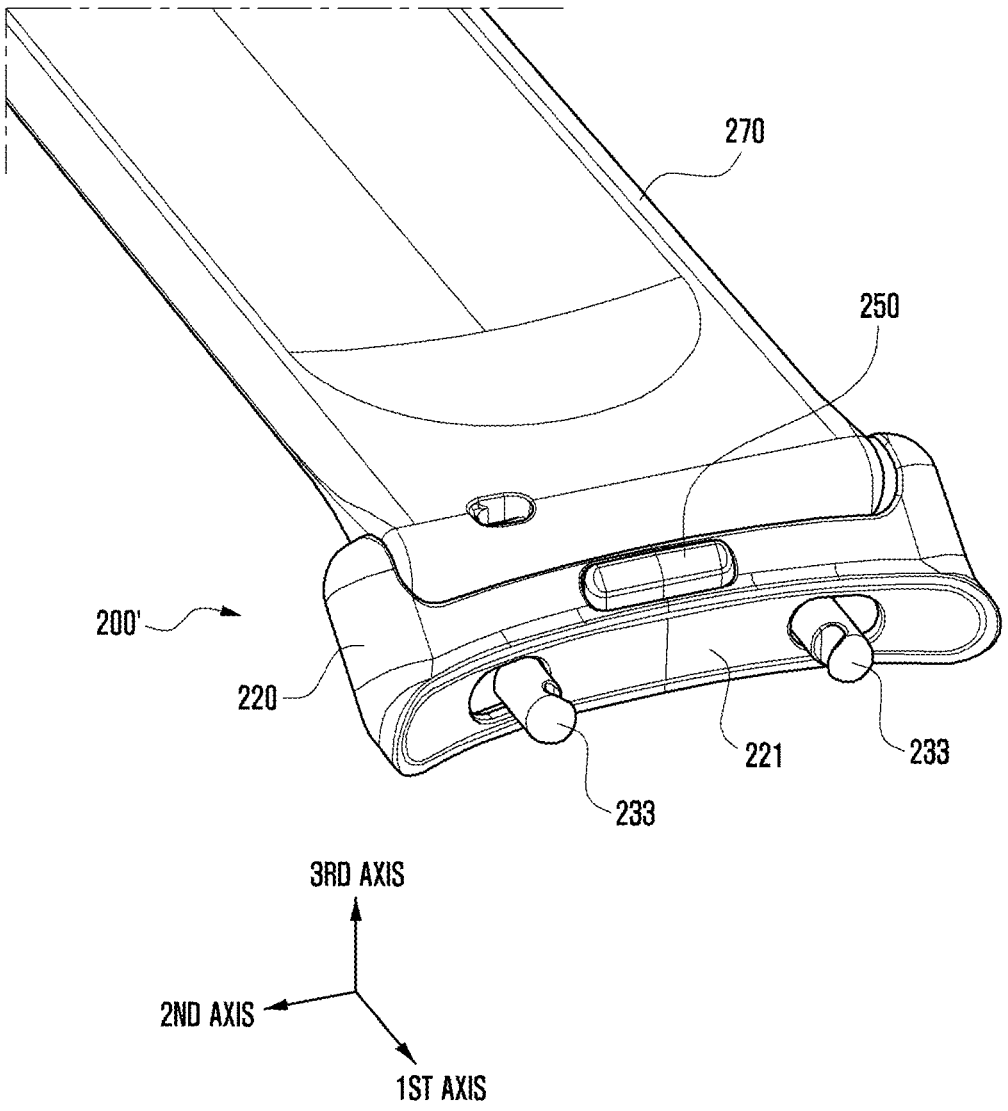
FIGS. 4A and 4B illustrate perspective views showing a strap adapter of an electronic device according to an embodiment of the disclosure.
Figure 4B:
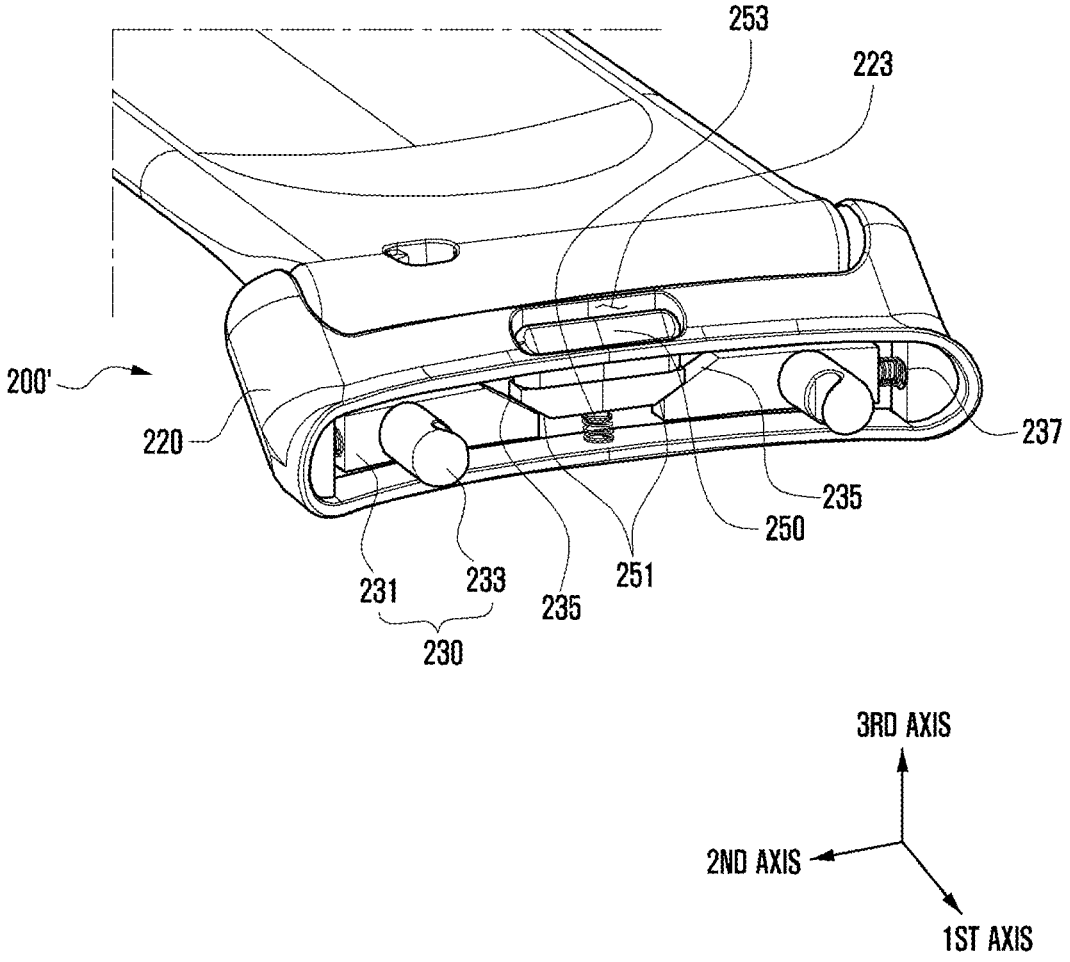

FIGS. 4A and 4B illustrate perspective views showing the strap adapter 200' of the electronic device 200 according to an embodiment of the disclosure. Specifically, FIG. 4A is a perspective view showing the other side of the strap adapter 200' to be connected to the main body (210 in FIGS. 2 and 3), and FIG. 4B is a perspective view showing a state where the housing cover 221 of the strap adapter 200' is removed for convenience and the button 250 is pressed to open the first fastening parts 230.

Referring to FIGS. 4A and 4B, the first fastening parts 230 are disposed symmetrically at both sides about the position of the button 250 in the second axial direction. When the user presses the button 250 in the third axial direction, this pressing force applied in the third axial direction is changed in the second axial direction by an interaction between the button inclined plane 251 and the fastening body inclined plane 235. The direction-changed force slidingly moves the fastening bodies 231 of the first fastening parts 230 to be opened (i.e., to be away from each other). In this state, the fastening hooks 233 of the first fastening parts 230 are not engaged with the second fastening parts (240 in FIG. 3).

When the pressing force is removed from the button 250, the button 250 is returned to protrude from the housing 220 by an elastic force of the spring 253 disposed between the button 250 and the housing 220. Then, by an elastic force of the springs 237 disposed between the fastening bodies 231 and the housing 220, the fastening bodies 231 of the first fastening parts 230 moves to be closed (i.e., to be close to each other). In this state, the fastening hooks 233 of the first fastening parts 230 are engaged with the second fastening parts 240.

Figure 5A:
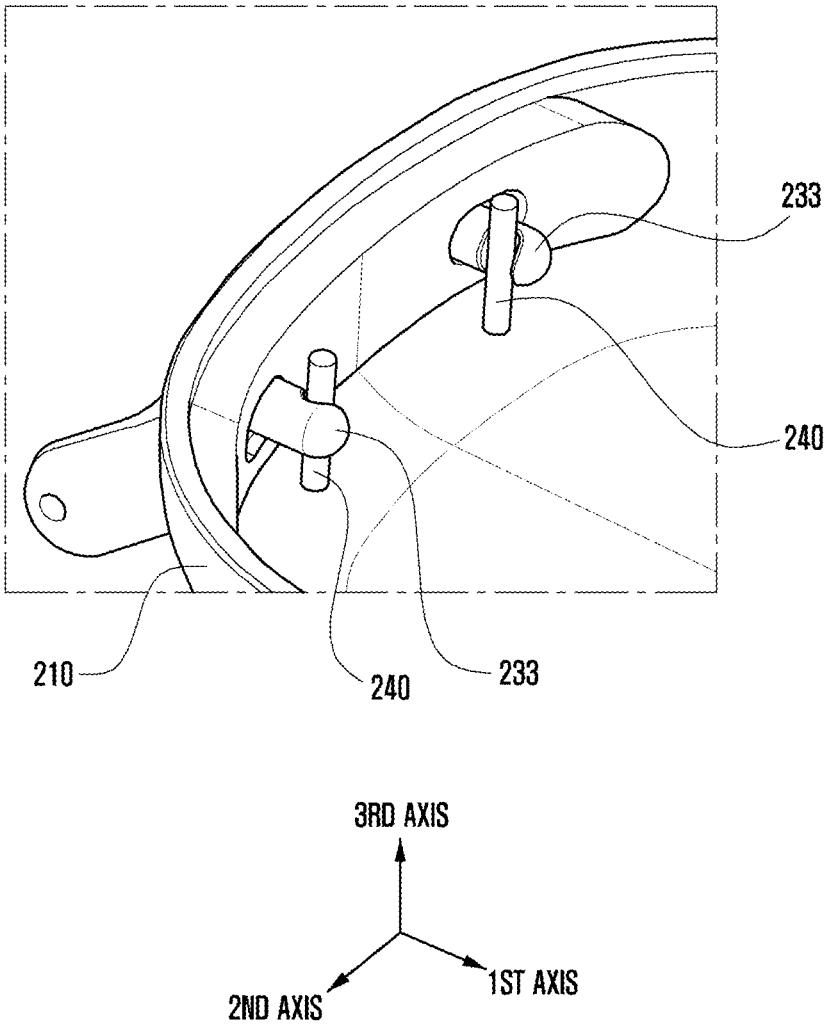
FIG. 5A illustrates a perspective view showing, with a main body removed in part, a state where a fastening hook of a first fastening part is engaged with a second fastening part and thereby a strap adapter of an electronic device according to an embodiment of the disclosure is connected to the main body.

FIG. 5A illustrates a perspective view showing, with the main body 210 removed in part, a state where the fastening hook 233 of the first fastening part 230 is engaged with the second fastening part 240 and thereby the strap adapter 200' of the electronic device 200 according to an embodiment of the disclosure is connected to the main body 210. In addition, FIG. 5B illustrates a perspective view showing, with the main body 210 removed in part, a state where the fastening hook 233 of the first fastening part 230 is not engaged with the second fastening part 240 and thereby the strap adapter 200' of the electronic device 200 according to an embodiment of the disclosure is separated from the main body 210.

Referring to FIG. 5A, the strap adapter 200' and the main body 210 are connected to each other when the fastening hooks 233 of the first fastening parts 230 are engaged with the second fastening parts 240 (e.g., pins) formed in the main body 210.

Figure 5B:
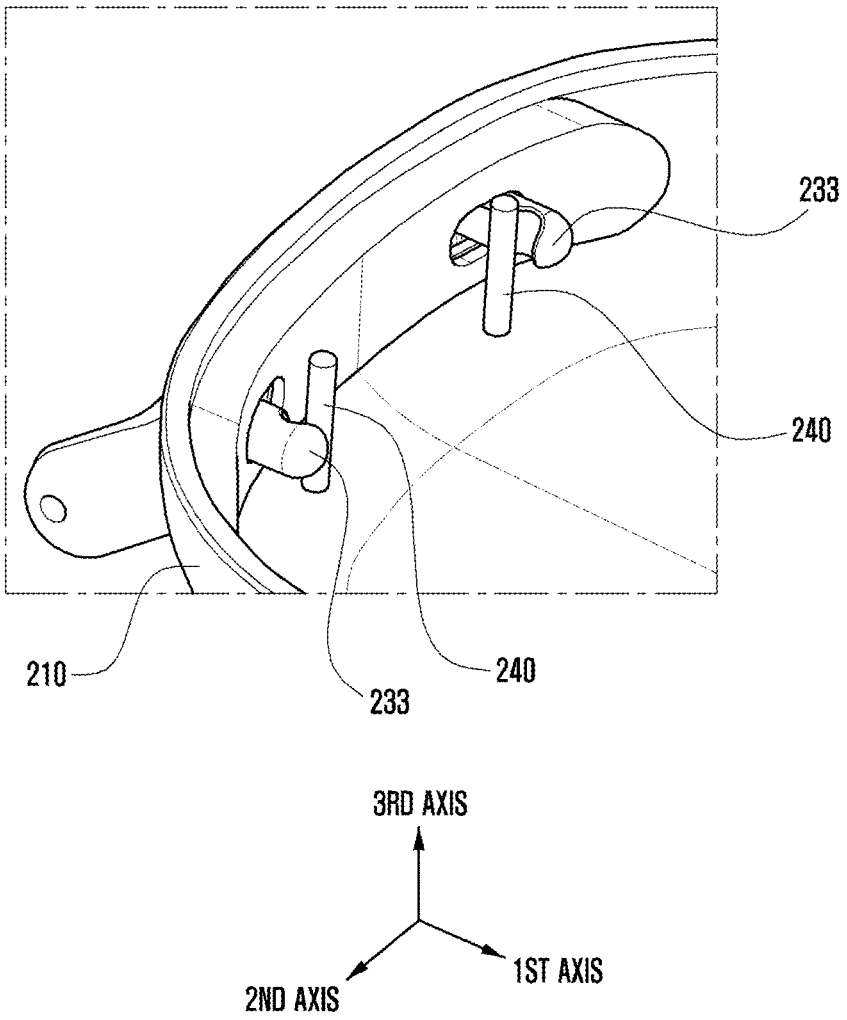
FIG. 5B illustrates a perspective view showing, with a main body removed in part, a state where a fastening hook of a first fastening part is not engaged with a second fastening part and thereby a strap adapter of an electronic device according to an embodiment of the disclosure is separated from the main body.

Referring to FIG. 5B, when the button 250 is pressed, the fastening hooks 233 of the first fastening parts 230, together with the fastening bodies 231, are moved to be away from each other. Therefore, the fastening hooks 233 are not engaged with the second fastening parts 240 (e.g., pins), and also the strap adapter 200' and the main body 210 are separated from each other.

In FIGS. 5A and 5B, the fastening hook 233 of the first fastening part 230 is depicted as having a hook shape, and the second fastening part 240 is depicted as having a pin shape. Alternatively, any shape or structure that allows engaging or releasing responsive to the movement of the fastening body 231 may be applied.

Figure 6A:
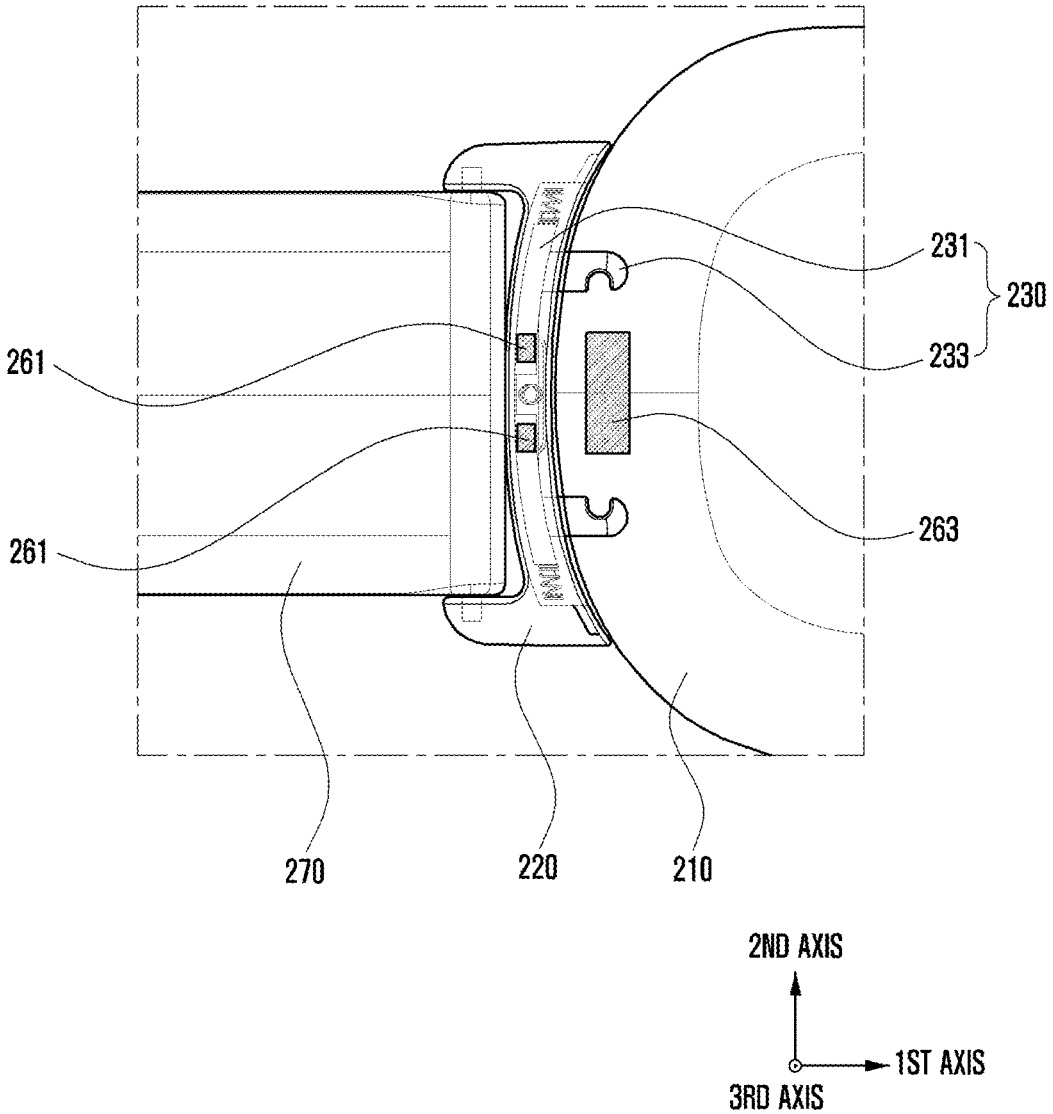
FIG. 6A illustrates a schematic view showing, focusing on a magnetic body, a case where a strap adapter of an electronic device according to another embodiment of the disclosure is connected to a main body.
Figure 6B:
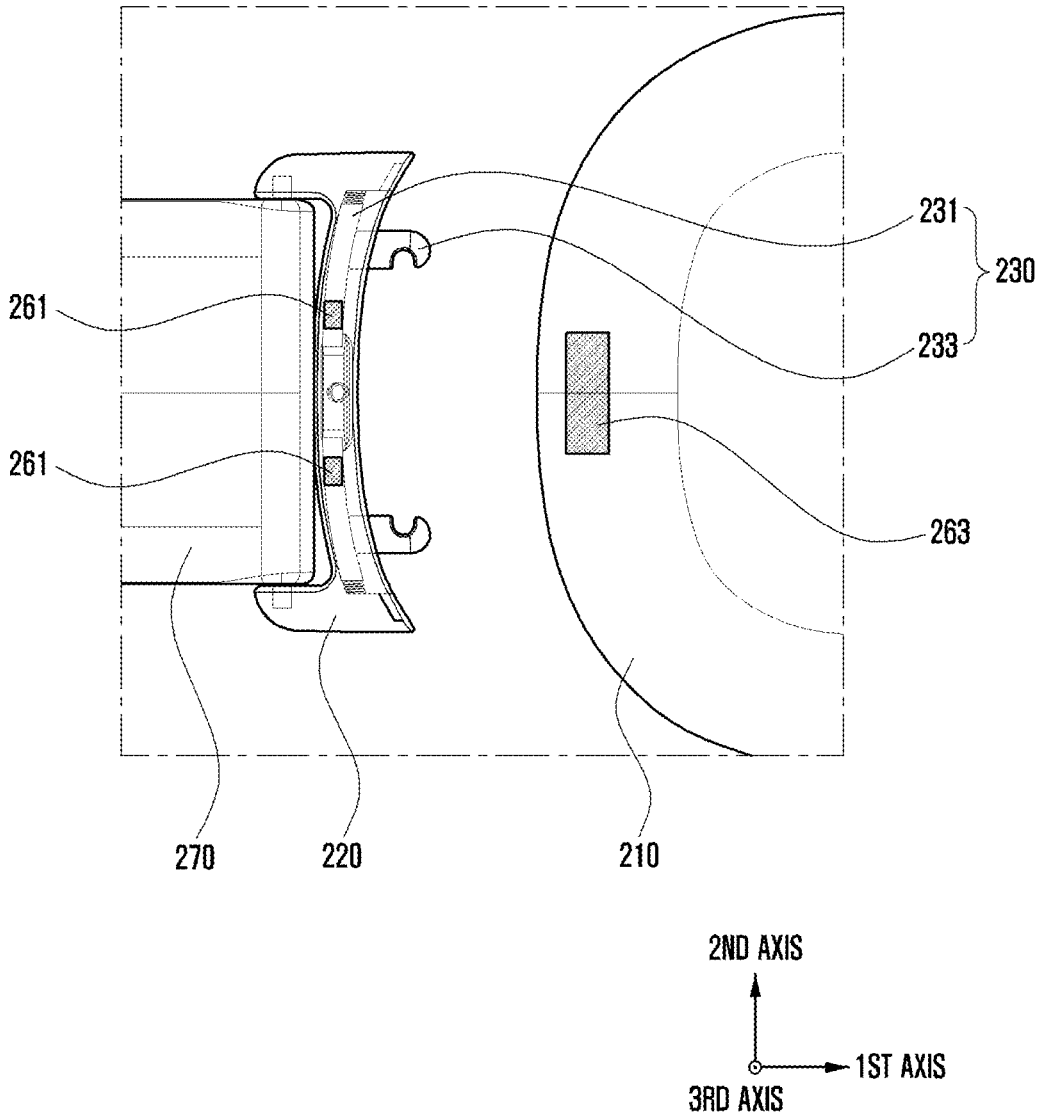
FIG. 6B illustrates a schematic view showing, focusing on a magnetic body, a case where a strap adapter of an electronic device according to another embodiment of the disclosure is separated from a main body.

FIG. 6A illustrates a schematic view showing a case where the strap adapter 200' of the electronic device 200 according to another embodiment of the disclosure is connected to the main body 210, and FIG. 6B illustrates a schematic view showing a case where the strap adapter 200' of the electronic device 200 according to another embodiment of the disclosure is separated from the main body 210. In particular, FIGS. 6A and 6B are depicted focusing on a first magnetic body 261 and a second magnetic body 263.

The electronic device 200 according to this embodiment may further include the first magnetic body 261 and the second magnetic body 263 to enhance a combining force between the strap adapter 200' and the main body 210 by the magnetic force of the first and second magnetic bodies 261 and 263. The first and second magnetic bodies 261 and 263 may be disposed to face each other and attract each other with opposite poles thereof (i.e., north and south). The first magnetic body 261 may be disposed in the housing 220 of the strap adapter 200' and may move together with the first fastening part 230. The second magnetic body 263 may be disposed in the main body 210 to be positioned near the strap adapter 200'.

Referring to FIG. 6A, the first magnetic body 261 may be disposed within a space extended from the second magnetic body 263 in the first axial direction. In this case, the first magnetic body 261 may be located in a space where the magnetic flux of the second magnetic body 263 is concentrated and thereby a strong magnetic field is formed. A magnetic force acting between the first and second magnetic bodies 261 and 263 may guide a connecting path when the strap adapter 200' and the body 210 are connected to each other. In addition, after connection, the magnetic force of the first and second magnetic bodies 261 and 263 may enhance a combining force between the strap adapter 200' and the main body 210.

Referring to FIG. 6B, the first magnetic body 261 may be disposed outside a space extended from the second magnetic body 263 in the first axial direction. In this case, the first magnetic body 261 may be located in a space where the density of the magnetic flux of the second magnetic body 263 is low and thereby a weak magnetic field is formed. Therefore, a magnetic force acting between the first and second magnetic bodies 261 and 263 is weakened, so that a separation of the strap adapter 200' and the main body 210 may be facilitated.

Figure 7:
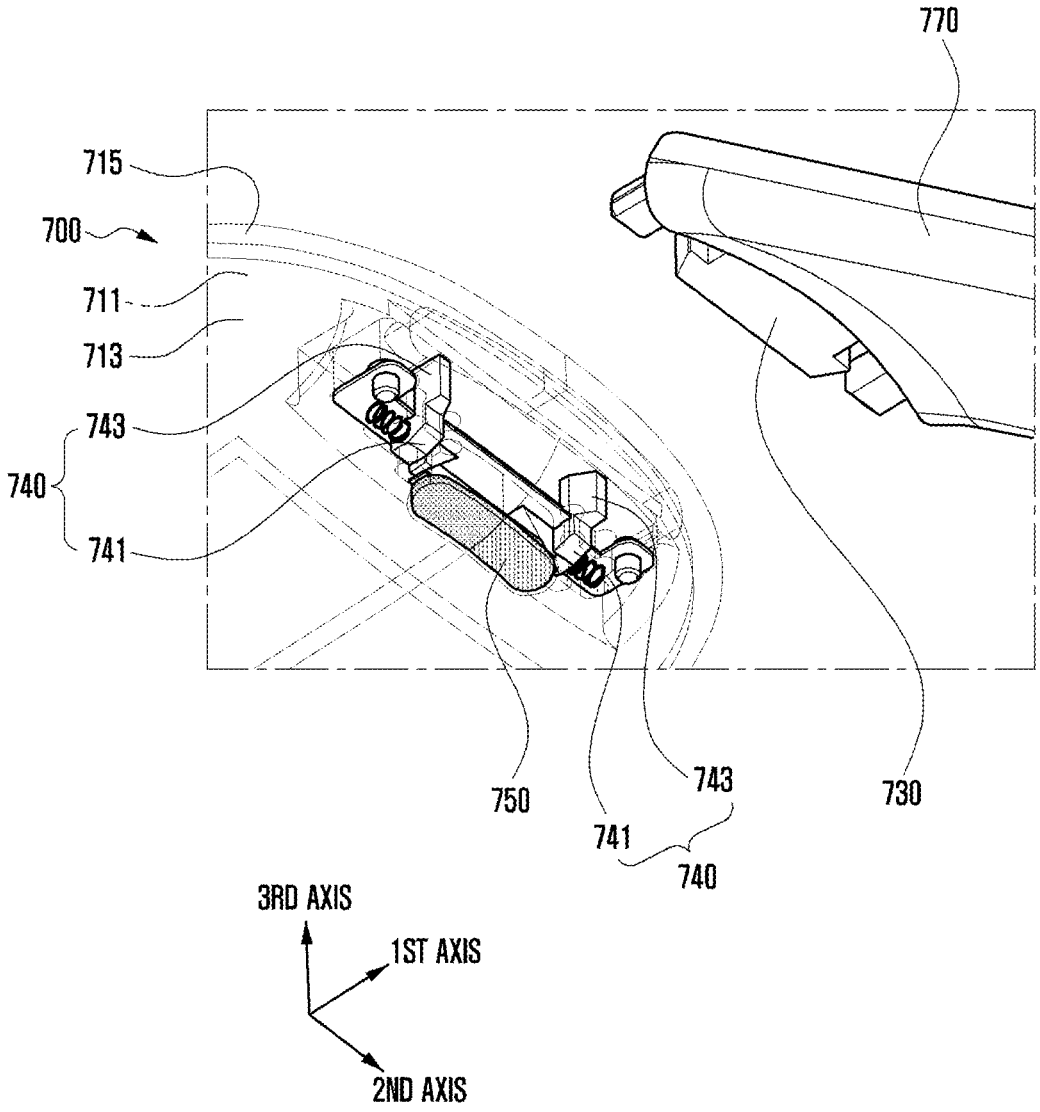
FIG. 7 illustrates a perspective view showing a case where a strap is connected to a main body of an electronic device according to still another embodiment of the disclosure.
Figure 8:
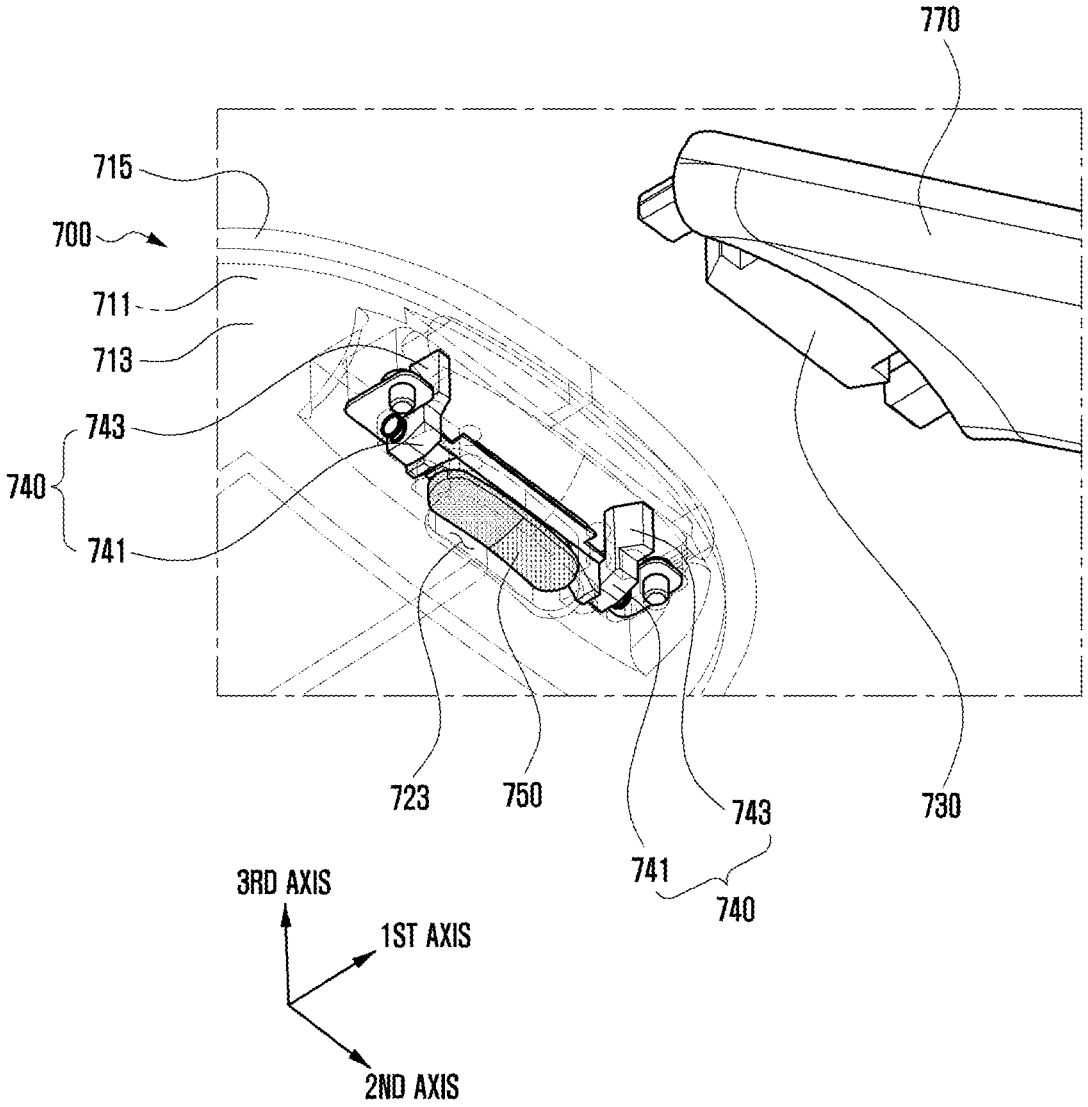
FIG. 8 illustrates a perspective view showing a case where a strap is separated from a main body of an electronic device according to still another embodiment of the disclosure.

FIG. 7 illustrates a perspective view showing a case where a strap 770 is connected to a main body 710 of an electronic device 700 according to still another embodiment of the disclosure, and FIG. 8 illustrates a perspective view showing a case where a strap 770 is separated from a main body 710 of an electronic device 700 according to still another embodiment of the disclosure. This embodiment corresponds to a case where the strap adapter 200' described above in FIGS. 1 to 6 is embedded in the main body 710. Hereinafter, only a difference will be described.

The electronic device 700 according to this embodiment may include the main body 710 and the strap 770. The main body 710 may include a front plate 711, a rear plate 713, a lateral member 715, a display), a fourth fastening part 740, and a button 750. The fourth fastening part 740 may have the same or similar structure as that of the first fastening part (e.g., 230 in FIG. 3). Each of the fourth fastening parts 740 may include a fastening body 741 and a fastening hook 743. The button 750 may be disposed in a hole 723 formed to accommodate the button 750 in the rear plate 713 of the main body 710. The button 750 may not be exposed to the outside when the user wears the electronic device 700. This may prevent the button 750 from being pressed due to a collision with an external object while the user wears the electronic device 700, and thereby preventing any unintentional separation of the electronic device 700.

According to this embodiment, the strap 770 may have a third fastening part 730 formed at one side thereof in the first axial direction. The third fastening part 730 may be engaged with the fourth fastening part 740 of the main body 710. In FIGS. 7 and 8, the third fastening part 730 is depicted as having a hook shape. Alternatively, the third fastening part 730 may have any shape (e.g., a pin or ring) or structure capable of being engaged with the fourth fastening part 740.

As described hereinbefore, embodiments of the disclosure allow a strap to be easily separated from a main body of a wearable electronic device by a press on a button, thereby easily and quickly replacing various straps of different designs.

In addition, embodiments of the disclosure provide an adapter structure for connecting a strap and a main body of an electronic device, thereby being capable of connecting an existing strap of spring bar type to a main body of a wearable electronic device.

According to an embodiment of the disclosure, a strap adapter 200' may include a housing 220 having a space therein and combined with a strap 270 at one side thereof in a first axial direction, a first fastening part 230 protruding from other side of the housing 220 and detachably connected to a main body 210, and a button 250 disposed in the housing 220, exposed at least in part to an outside of the housing 220, and moving the first fastening part 230 to be separated from the main body 210.

The first fastening part 230 may include a fastening body 231 disposed in the housing 220 and moving slidingly in a second axial direction which corresponds to a width direction of the strap 270 and is perpendicular to the first axial direction, and a fastening hook 233 protruding from the fastening body 231 toward the main body 210, exposed at least in part to the outside of the housing 220, and engaged with the main body 210.

The button 250 may be movable in a third axial direction perpendicular to both the first and second axial directions, and the button 250 may be in contact with the fastening body 231 and thereby move the first fastening part 230.

The first fastening part 230 may be composed of a plurality of first fastening parts disposed in the housing 220 and moving slidingly to be away from or close to each other in the second axial direction by manipulation of the button 250.

The button 250 may include button inclined planes 251 at both sides thereof in the second axial direction and at a lower end thereof in the third axial direction, and each of the first fastening parts 230 may include a fastening body inclined plane 235 at a side thereof facing the button inclined plane 251. In addition, when the button 250 is pressed into the housing 220 in the third axial direction, the button inclined planes 251 being in contact with the fastening body inclined planes 235 may slidingly move the fastening bodies 231 of the first fastening parts 230 in the second axial direction such that the first fastening part 230 is separated from the main body 210.

The strap adapter 200' may further include a first magnetic body 261 disposed in the housing 220 and providing, together with a second magnetic body 263 disposed in the main body 210, a combining force between the housing 220 and the main body 210.

The first magnetic body 261 may be disposed on the fastening body 231 and move together with the first fastening part 230, and when the housing 220 is separated from the main body 210, a magnetic force acting between the first and second magnetic bodies 261 and 263 may be weakened.

The strap 270 may be combined with one side of the housing 220 through a spring bar 280.

According to an embodiment of the disclosure, an electronic device 200 may include a main body 210 including a front plate 211, a rear plate 213 disposed to be spaced apart from the front plate 211, a lateral member 215 surrounding a space between the front plate 211 and the rear plate 213, and a display viewed through at least a portion of the front plate 211, a housing 220 having a space therein and combined with a strap 270 at one side thereof in a first axial direction, a first fastening part 230 protruding from other side of the housing 220 toward the main body 210 and detachably connected to the main body 210, a second fastening part 240 formed in the main body 210 and engaged with the first fastening part 230, and a button 250 disposed in the housing 220, exposed at least in part to an outside of the housing 220, and moving the first fastening part 230 to be separated from the second fastening part 240.

The first fastening part 230 may include a fastening body 231 disposed in the housing 220 and moving slidingly in a second axial direction which corresponds to a width direction of the strap 270 and is perpendicular to the first axial direction, and a fastening hook 233 protruding from the fastening body 231 toward the main body 210, exposed at least in part to the outside of the housing 220, and engaged with the main body 210.

The button 250 may be movable in a third axial direction perpendicular to both the first and second axial directions, and the button 250 may be in contact with the fastening body 231 and thereby move the first fastening part 230.

The first fastening part 230 may be composed of a plurality of first fastening parts disposed in the housing 220 and moving slidingly to be away from or close to each other in the second axial direction by manipulation of the button 250.

The button 250 may include button inclined planes 251 at both sides thereof in the second axial direction and at a lower end thereof in the third axial direction, and each of the first fastening parts 230 may include a fastening body inclined plane 235 at a side thereof facing the button inclined plane 251. In addition, when the button 250 is pressed into the housing 220 in the third axial direction, the button inclined planes 251 being in contact with the fastening body inclined planes 235 may slidingly move the fastening bodies 231 of the first fastening parts 230 in the second axial direction such that the first fastening part 230 is separated from the main body 210.

The electronic device may further include a first magnetic body 261 disposed in the housing 220, and a second magnetic body 263 disposed in the main body 210. In this case, the first and second magnetic bodies 261 and 263 may be disposed to face each other and attract each other with opposite poles thereof.

The first magnetic body 261 may be disposed on the fastening body 231 and move together with the first fastening part 230, and when the housing 220 is separated from the main body 210, a magnetic force acting between the first and second magnetic bodies 261 and 263 may be weakened.

The second magnetic body 263 may be disposed to be located at a center of the housing 220 in the second axial direction, and when the first fastening part 230 moves by manipulation of the button 250, the first magnetic body 261 and the second magnetic body 263 may be not overlapped with each other in the first axial direction.

The strap 270 may be combined with one side of the housing 220 through a spring bar 280.

The second fastening part 240 may be a fastening pin formed to be engaged with the fastening hook 233 of the first fastening part 230.

The housing 220 may be disposed at a plurality of positions around the main body 210 in the first axial direction.

According to another embodiment of the disclosure, an electronic device 700 may include a main body 710 including a front plate 711, a rear plate 713 disposed to be spaced apart from the front plate 711, a lateral member 715 surrounding a space between the front plate 711 and the rear plate 713, and a display viewed through at least a portion of the front plate 711, a third fastening part combined with a strap 770 at one side thereof in a first axial direction and protruding from other side thereof toward the main body 710 to be detachably connected to the main body 710, a fourth fastening part formed in the main body 710 and engaged with the third fastening part, and a button 750 disposed in the main body 710, exposed at least in part to an outside of the main body 710, and moving the fourth fastening part to be separated from the third fastening part.

Although the present disclosure has been described with various embodiments, various changes and modifications may be suggested to one skilled in the art. It is intended that the present disclosure encompass such changes and modifications as fall within the scope of the appended claims.

What is claimed is:

1. A strap adapter comprising:

a housing having a space therein and combined with a strap at one side of the housing in a first axial direction;

a first fastening part protruding from another side of the housing and connected to a main body; and a button disposed in the housing, the button exposed at least in part to an outside of the housing, the button configured to move the first fastening part to be separated from the main body.

2. The strap adapter of claim 1, wherein the first fastening part includes:

a fastening body disposed in the housing and configured to move slidingly in a second axial direction, the second axial direction corresponding to a width direction of the strap and being perpendicular to the first axial direction; and a fastening hook protruding from the fastening body toward the main body, the fastening hook exposed at least in part to the outside of the housing, the fastening hook engaged with the main body.

3. The strap adapter of claim 2, wherein:

the button is movable in a third axial direction perpendicular to both the first and second axial directions, and the button is in contact with the fastening body and thereby moves the first fastening part.

4. The strap adapter of claim 3, wherein the first fastening part is composed of a plurality of first fastening parts disposed in the housing and configured to move slidingly to be away from or close to each other in the second axial direction by manipulation of the button.

5. The strap adapter of claim 4, wherein:

the button includes button inclined planes at both sides thereof in the second axial direction and at a lower end thereof in the third axial direction, each of the first fastening parts includes a fastening body inclined plane at a side thereof facing the button inclined plane, and when the button is pressed into the housing in the third axial direction, the button inclined planes being in contact with the fastening body inclined planes slidingly move the fastening bodies of the first fastening parts in the second axial direction such that the first fastening part is separated from the main body.

6. The strap adapter of claim 3, further comprising a first magnetic body disposed in the housing and configured to provide, together with a second magnetic body disposed in the main body, a combining force between the housing and the main body.

7. The strap adapter of claim 6, wherein:

the first magnetic body is disposed on the fastening body and moves together with the first fastening part, and when the housing is separated from the main body, a magnetic force acting between the first and second magnetic bodies is weakened.

8. The strap adapter of claim 1, wherein the strap is combined with one side of the housing through a spring bar.

9. An electronic device comprising:

a main body including a front plate, a rear plate disposed to be spaced apart from the front plate, a lateral member surrounding a space between the front plate and the rear plate, and a display viewed through at least a portion of the front plate;

a housing having a space therein and combined with a strap at one side of the housing in a first axial direction;

a first fastening part protruding from another side of the housing toward the main body and connected to the main body;

a second fastening part formed in the main body and engaged with the first fastening part; and a button disposed in the housing, the button exposed at least in part to an outside of the housing, the button configured to move the first fastening part to be separated from the second fastening part.

10. The electronic device of claim 9, wherein the first fastening part includes:

a fastening body disposed in the housing and configured to move slidingly in a second axial direction, the second axial direction corresponding to a width direction of the strap and being perpendicular to the first axial direction; and a fastening hook protruding from the fastening body toward the main body, the fastening hook exposed at least in part to the outside of the housing, the fastening hook engaged with the main body.

11. The electronic device of claim 10, wherein the second fastening part is a fastening pin formed to be engaged with the fastening hook of the first fastening part.

12. The electronic device of claim 10, wherein:

the button is movable in a third axial direction perpendicular to both the first and second axial directions, and the button is in contact with the fastening body and thereby moves the first fastening part.

13. The electronic device of claim 12, wherein the first fastening part is composed of a plurality of first fastening parts disposed in the housing and configured to move slidingly to be away from or close to each other in the second axial direction by manipulation of the button.

14. The electronic device of claim 13, wherein:

the button includes button inclined planes at both sides thereof in the second axial direction and at a lower end thereof in the third axial direction, each of the first fastening parts includes a fastening body inclined plane at a side thereof facing the button inclined plane, and when the button is pressed into the housing in the third axial direction, the button inclined planes being in contact with the fastening body inclined planes slidingly move the fastening bodies of the first fastening parts in the second axial direction such that the first fastening part is separated from the main body.

15. The electronic device of claim 12, further comprising:

a first magnetic body disposed in the housing; and a second magnetic body disposed in the main body, wherein the first and second magnetic bodies are disposed to face each other and attract each other with opposite poles thereof.

16. The electronic device of claim 15, wherein:

the first magnetic body is disposed on the fastening body and moves together with the first fastening part, and when the housing is separated from the main body, a magnetic force acting between the first and second magnetic bodies is weakened.

17. The electronic device of claim 16, wherein:

the second magnetic body is disposed to be located at a center of the housing in the second axial direction, and when the first fastening part moves by manipulation of the button, the first magnetic body and the second magnetic body are not overlapped with each other in the first axial direction.

18. The electronic device of claim 9, wherein the strap is combined with one side of the housing through a spring bar.

19. The electronic device of claim 9, wherein the housing is disposed at a plurality of positions around the main body in the first axial direction.

20. An electronic device comprising:

a main body including a front plate, a rear plate disposed to be spaced apart from the front plate, a lateral member surrounding a space between the front plate and the rear plate, and a display viewed through at least a portion of the front plate;

a third fastening part combined with a strap at one side of the third fastening part in a first axial direction, the third fastening part protruding from another side of the third fastening part toward the main body to be connected to the main body;

a fourth fastening part formed in the main body and engaged with the third fastening part; and a button disposed in the main body, exposed at least in part to an outside of the main body, and moving the fourth fastening part to be separated from the third fastening part.

* * * * *